US008075352B2

(12) United States Patent
Kim

(10) Patent No.: US 8,075,352 B2
(45) Date of Patent: Dec. 13, 2011

(54) CONNECTING TERMINAL FOR STORAGE BATTERY

(76) Inventor: Hwang-Chang Kim, Yongin-si (KR)

( * ) Notice: Subject to any disclaimer, the term of this patent is extended or adjusted under 35 U.S.C. 154(b) by 154 days.

(21) Appl. No.: 11/610,839

(22) Filed: Dec. 14, 2006

(65) Prior Publication Data

US 2010/0317242 A1 Dec. 16, 2010

(51) Int. Cl.
*H01R 4/50* (2006.01)

(52) U.S. Cl. ..... 439/773; 439/759

(58) Field of Classification Search ..... 439/522, 439/754, 759, 765, 773
See application file for complete search history.

(56) References Cited

U.S. PATENT DOCUMENTS 3,568,139 A * 3/1971 Delzer ..... 439/759
6,776,669 B2 * 8/2004 Krause et al. ..... 439/772

* cited by examiner

*Primary Examiner* — Khiem Nguyen
(74) *Attorney, Agent, or Firm* — Lathrop & Gage LLP

(57) ABSTRACT

Disclosed is a connection terminal for a storage battery for coupling the storage battery of a car with a connection wire. The connection terminal includes: a fixing plate having a hole of a predetermined size formed at the center thereof; a fixing member vertically mounted in the hole of the fixing plate; an insertion part mounted at a side of the fixing plate and formed in a round shape opened at a side thereof for inserting a post terminal of the storage battery; a cover for covering the insertion part; and a tightening member for coupling the insertion part with a post terminal of the storage battery by changing a diameter of the insertion part. The tightening member may be formed by tapered walls of the cover, which is connected to the fixing member by a hook or a hinge.

8 Claims, 10 Drawing Sheets

CONNECTING TERMINAL FOR STORAGE BATTERY

RELATED APPLICATION

This application claims priority to Korean Patent Application Serial No. 20-2005-0035434, filed Dec. 16, 2005, the disclosure of which is incorporated herein by reference.

BACKGROUND

1. Field of the Invention

The present invention relates to a connection terminal for a storage battery for connecting a connection wire with a storage battery of a car, and more particularly, to a connection terminal for a storage battery, which can firmly connect a post terminal of the storage battery and an insertion part of the connection terminal only by mounting a cover without using any separate tightening member.

2. Background Art

In general, as shown in FIG. 1, a conventional connection terminal for a storage battery is made of a plate form, and includes a fixing plate 20 having a coupling hole of a predetermined size formed at the center thereof, a fixing member 30 vertically mounted in the coupling hole formed at the center of the fixing plate 20, an insertion part 40 disposed at a side of the fixing plate 20 and formed in a round shape opened at a side thereof for inserting a post terminal of a storage battery (not shown) thereto, and a tightening part 50 formed at a side of the insertion part 40 in a vertically symmetric form.

The tightening part 50 includes tightening holes formed at the front and rear sides for adjusting a diameter of the insertion part 40 with a tightening bolt 51 and a tightening nut 52, and a hollow fixing pipe 55 disposed between the tightening bolt 51 and the tightening nut 52 for preventing excessive transformation of the insertion part.

Moreover, the conventional connection terminal 10 for the storage battery includes a terminal 70 for mounting a connection wire (not shown) connected in series or parallel for supplying electricity into a car from the storage battery. The terminal 70 includes a coupling hole formed at a side thereof for inserting the fixing member 30 thereinto. The terminal 70 is mounted on the fixing plate 20 in such a way that a fixing nut 31 is coupled with the fixing member 30 by interposing a washer 32 between the terminal 70 and the fixing nut 31.

In addition, a cover 60 of an approximately '¬' form is covered on the connection terminal 10 in order to prevent corrosion of the connection terminal 10 by preventing exposure of it to sulfurous acid gas generated from the storage battery.

However, the conventional connection terminal for the storage battery has a disadvantage in that it is uneasy to install the connection terminal since the tightening bolt 51 and the tightening nut 52 are used as the tightening member 50 for adjusting the diameter of the insertion part 40.

Furthermore, the conventional connection terminal for the storage battery has another disadvantage in that it shows a complicated appearance and the cover 60 may be separated from the terminal 70 since the cover 60 is coupled with the terminal 70 without setting position of the cover 60 and the cover 60 and the terminal 70 are not coincided with each other in position.

Additionally, the conventional connection terminal for the storage battery has a further disadvantage in that the post terminal of the storage battery is damaged so much as not to be used further since a user sometimes tightens the tightening bolt 51 and the tightening nut 52 excessively to firmly assemble the connection terminal by reducing the diameter of the insertion part 40.

SUMMARY

Accordingly, the present invention has been made to solve the above problems occurring in the prior art, and it is an object of the present invention to provide a connection terminal for a storage battery, which can firmly couple an insertion part with a post terminal of the storage battery only by covering a cover on the insertion part without using any separate tightening member, thereby enhancing a user's convenience.

It is another object of the present invention to provide a connection terminal for a storage battery, which can locate the cover at a correct position by integrating the cover with the insertion part using a hinged structure, thereby preventing complication of layout and separation of the cover from the insertion part.

It is a further object of the present invention to provide a connection terminal for a storage battery, which has an interval-keeping member mounted on side walls of the cover, thereby applying sufficient tightening force to the insertion part by preventing enlargement of an interval between the side walls of the cover when the insertion part is tightened.

It is another object of the present invention to provide a connection terminal for a storage battery, which can permit the user to firmly couple the insertion part with the post terminal of the storage battery only with the user's power without using any separate tightening member, thereby permitting anybody to easily operate it and preventing damage of the post terminal of the storage battery due to excessive external force.

To accomplish the above objects, according to the present invention, there is provided a connection terminal for a storage battery, which includes a fixing plate having a hole of a predetermined size formed at the center thereof, a fixing member vertically mounted in the hole of the fixing plate, an insertion part mounted at a side of the fixing plate and formed in a round shape opened at a side thereof for inserting a post terminal of the storage battery thereto, and a tightening member for coupling the insertion part with a post terminal of the storage battery by changing a diameter of the insertion part, wherein the tightening member comprises: a pair of projections extending from the opened portion of the insertion part in a direction opposed to the fixing plate; a supporting member spaced from the surface of the projections at a predetermined interval and having both ends fixed on the projections; a cover for covering the insertion part to prevent damages due to sulfurous acid gas generated from the storage battery and reducing a diameter of the insertion part; and a hook mounted on the cover to be coupled to the supporting member, the hook forming a rotational center of the cover together with the supporting member.

The cover includes a head portion having the hook mounted on the side thereof and sidewalls for surrounding the insertion part, and a grip extending from the upper surface of the head portion. The sidewalls are tapered in such a way that the inner diameter is gradually reduced from the opened bottom to the top thereof.

Furthermore, the terminal having a hole for inserting the fixing member thereinto and a connection wire for supplying electricity from the storage battery is mounted between the fixing plate and the cover, and fixed on the fixing plate by a fixing nut coupled to the fixing member.

In another aspect, according to the present invention, there is provided a connection terminal for a storage battery, which includes a fixing plate having a hole of a predetermined size formed at the center thereof, a fixing member vertically mounted in the hole of the fixing plate, an insertion part mounted at a side of the fixing plate and formed in a round shape opened at a side thereof for inserting a post terminal of the storage battery thereto, and a tightening member for coupling the insertion part with a post terminal of the storage battery by changing a diameter of the insertion part, wherein the tightening member comprises: a pair of projection plates extending from the opened portion of the insertion part in a direction opposed to the fixing plate; a cover for covering the insertion part to prevent damage due to sulfurous acid gas generated from the storage battery and reducing a diameter of the insertion part; and a hinge pin for rotatably coupling a hinged portion of the projection plate and a hinged portion of the cover with each other.

Moreover, the cover includes: a head portion having the hinged portion formed on the side thereof and side walls spaced apart from each other at a predetermined interval for surrounding the insertion part; a grip extending from the upper surface of the head portion; and interval-keeping means respectively mounted at the front side and the rear side of the head portion for preventing expansion of an interval between the side walls when the cover is coupled with the insertion part.

Additionally, the interval-keeping means includes a straight portion of a predetermined width inserted into slots respectively formed in the side walls, and holding portions formed at both ends of the straight portion and being greater in size than the slots of the side walls for preventing enlargement of an interval between the side walls.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to the preferred embodiment of the present invention with reference to the attached drawings.

Figure 1:
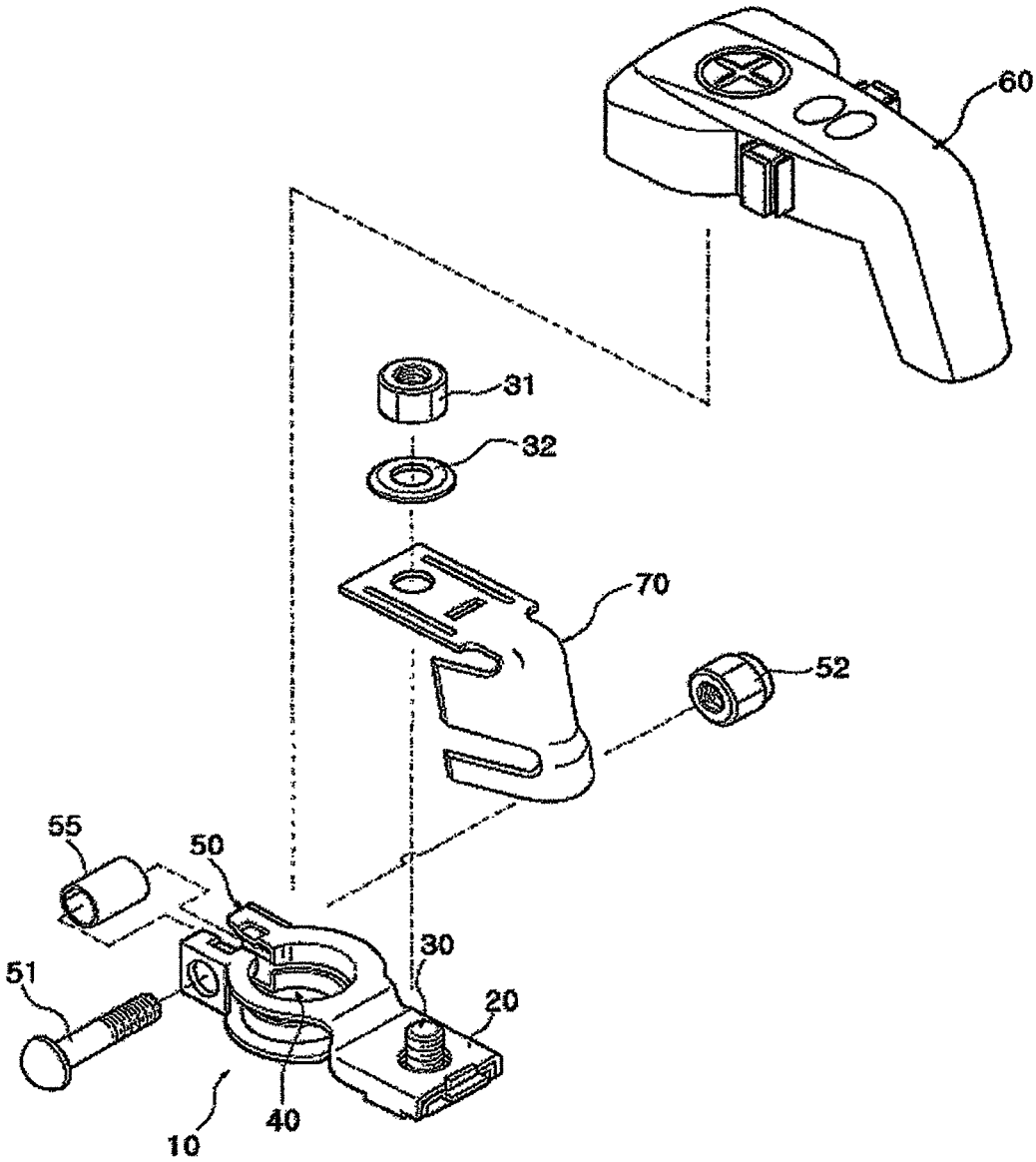
FIG. 1 PRIOR ART
FIG. 1 is an exploded perspective view of a conventional connection terminal for a storage battery.
Figure 2:
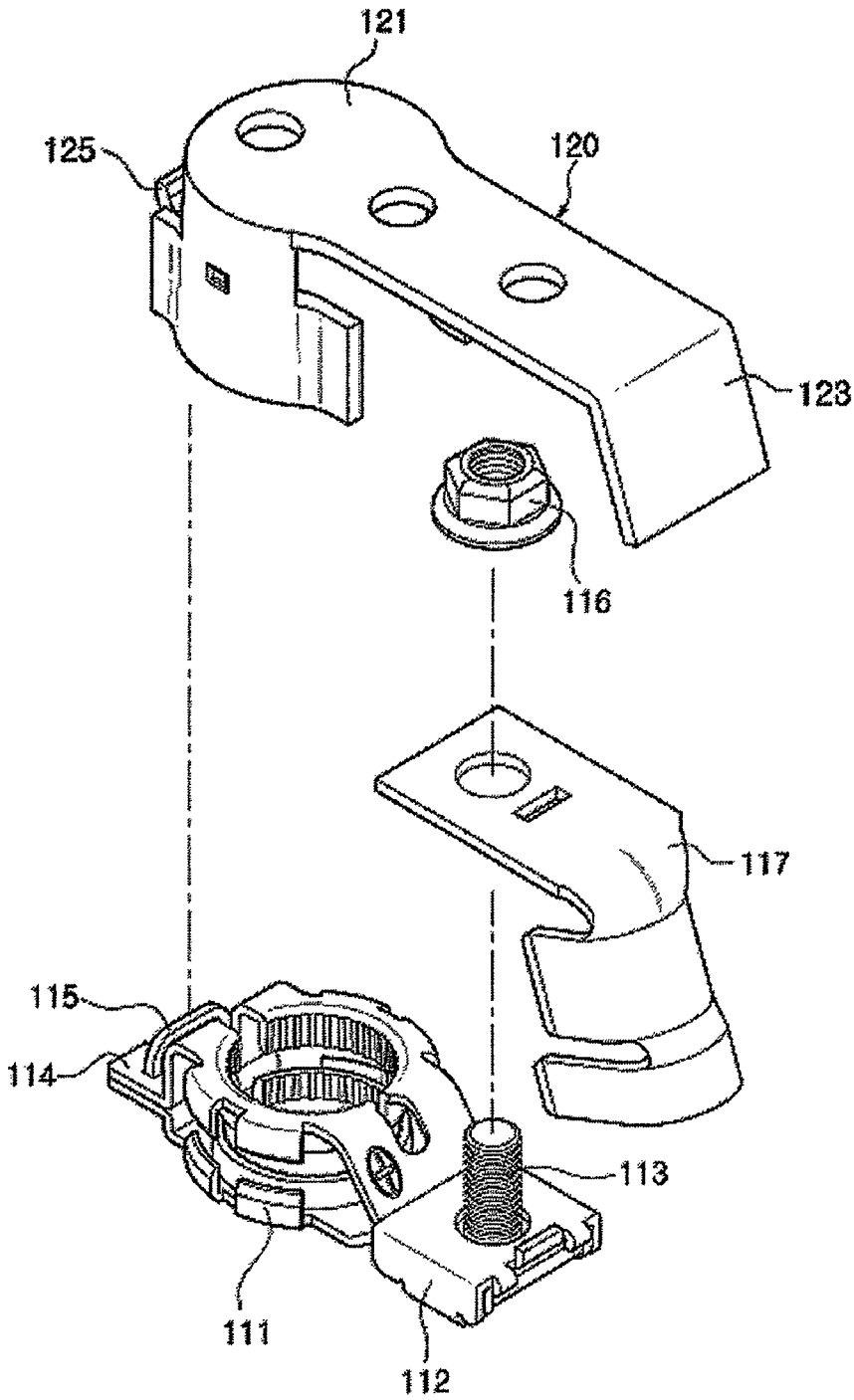
FIG. 2 is an exploded perspective view of a connection terminal for a storage battery according to a first preferred embodiment of the present invention.
Figure 3:
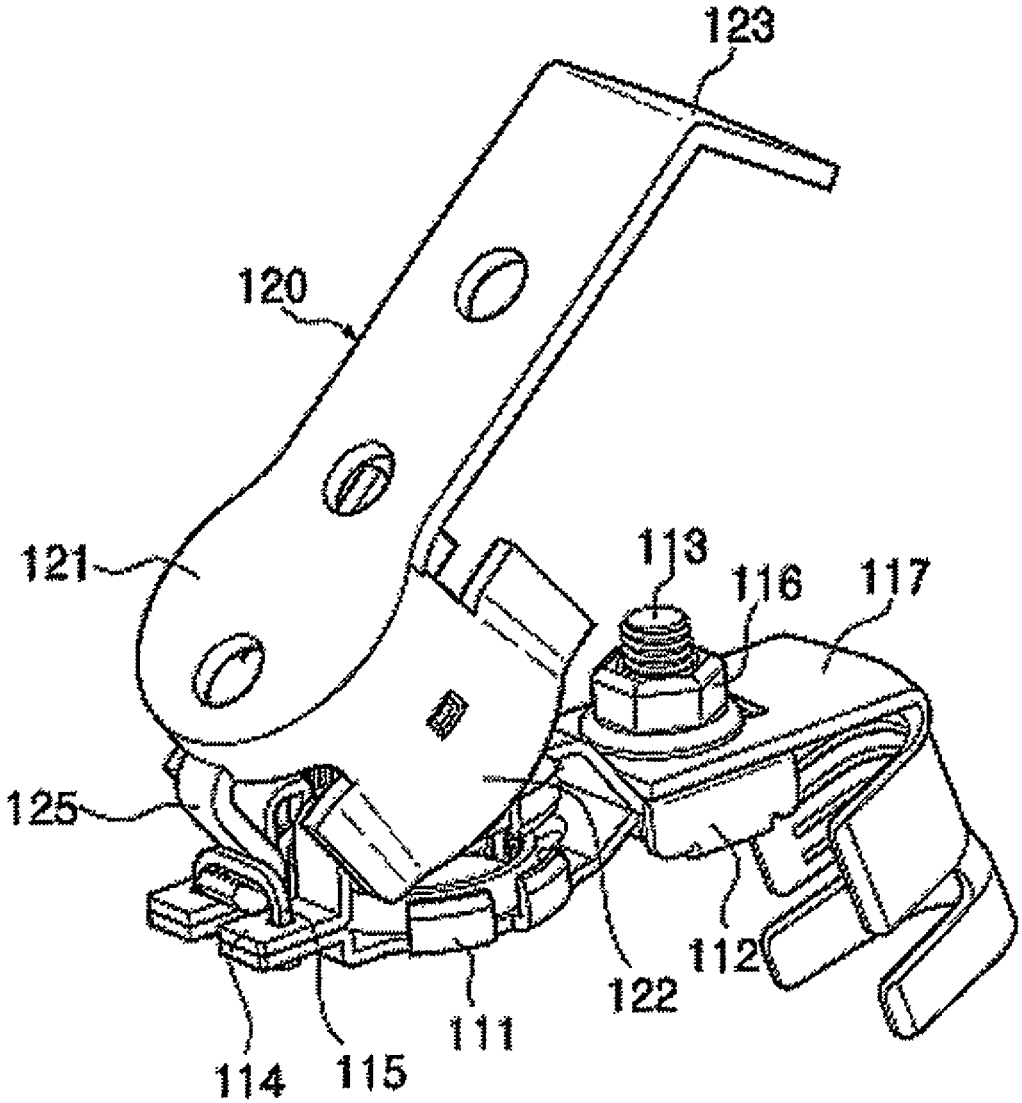
FIG. 3 is a perspective view showing a state before a diameter change of an insertion part according to the first preferred embodiment of the present invention.
Figure 4:
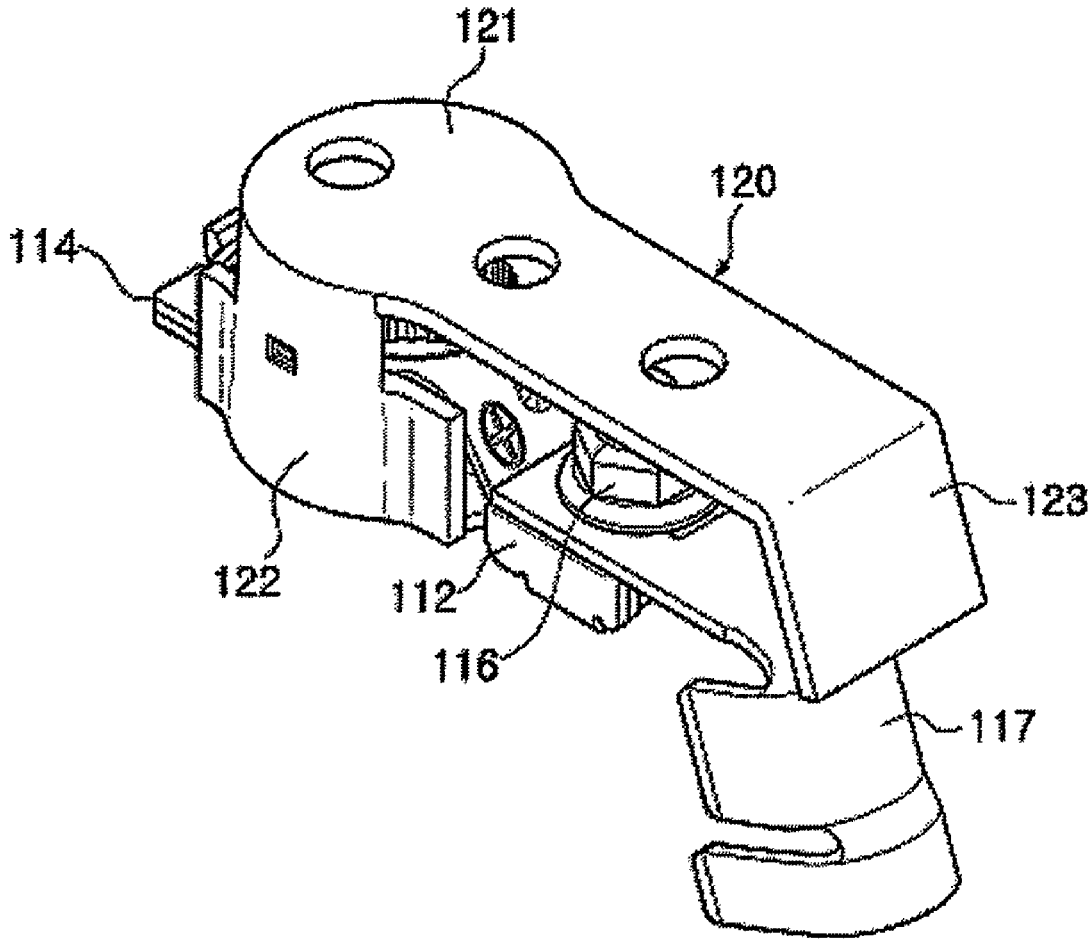
FIG. 4 is a perspective view showing a state after the diameter change of the insertion part according to the first preferred embodiment of the present invention.

As shown in FIGS. 2 to 4 showing a first preferred embodiment of the present invention, a connection terminal for a storage battery includes: a fixing plate 112 having a hole of a predetermined size formed at the center thereof; a fixing member 113 vertically mounted in the hole of the fixing plate 112; an insertion part 111 mounted at a side of the fixing plate 112 and formed in a round shape opened at a side thereof for inserting a post terminal of the storage battery thereto; a pair of projections 114 extending from the opened portion of the insertion part 111 in a direction opposed to the fixing plate 112; a supporting member 115 spaced from the surface of the projections 114 at a predetermined interval and having both ends fixed on the projections 114; a cover 120 for covering the insertion part 111 to prevent damage due to sulfurous acid gas generated from the storage battery and reduce a diameter of the insertion part 111; a hook 125 mounted on the cover 120 to be coupled to the supporting member 115, the hook forming a rotational center of the cover 120 together with the supporting member 115; a terminal 117 mounted between the fixing plate 112 and the cover 120, the terminal having a hole for inserting the fixing member 113 thereinto and a connection wire for supplying electricity from the storage battery; and a fixing nut 116 coupled to the fixing member 113 for fixing the terminal 117 on the fixing plate 112, wherein a washer is interposed between the terminal 117 and the fixing nut 116.

The cover 120 includes a head portion 121 having the hook 125 mounted on the side thereof and sidewalls 122 for surrounding the insertion part 111, and a grip 123 extending from the upper surface of the head portion 121. At this time, the sidewalls 122 are tapered in such a way that the inner diameter is gradually reduced from the opened bottom to the top, and the diameter of the insertion part 111 is gradually reduced when the cover 120 is coupled with the insertion part 111 deeply.

The connection terminal according to the first preferred embodiment of the present invention can be firmly coupled to the post terminal of the storage battery only by mounting the cover.

To install the terminal 117, the insertion part 111 is located at a position where the post terminal of the storage battery is fit to the connection terminal, the terminal 117 is located at a position where the connection wire connected to the corresponding post terminal is mounted on the terminal 117, and the fixing nut 116 is coupled with the fixing member 113 in a state where the washer is interposed between the terminal 117 and the fixing nut 116. At this time, instead of interposing the washer, as shown in the drawing, a washer-faced nut can be used as the fixing nut 116.

After that, the hook 125 of the cover 120 is hooked on the supporting member 115, and the cover 120 is mounted by manipulation of the grip 123. That is, when the head portion 121 of the cover 120 is fit on the outer surface of the insertion part 111, the diameter of the insertion part 111 is reduced by the shape of the side wall 122, and then, the insertion part 111 is firmly coupled with the post terminal of the storage battery in close contact with the post terminal. At this time, since the side wall 122 of the head portion 121 is tapered in such a way that the diameter of the head portion 121 is gradually reduced toward the upper portion of the head portion 121, when the head portion 121 is mounted deeper, the coupling between the insertion part 111 and the post terminal becomes more film.

Consequently, the insertion part 111 of the connection terminal can be firmly coupled with the post terminal of the storage battery by mounting just the cover 120 without using any separate tightening member.

After that, the hook 125 of the cover 120 is hooked on the supporting member 115, and the cover 120 is mounted by manipulation of the grip 123. That is, when the head portion 121 of the cover 120 is fit on the outer surface of the insertion part 111, the diameter of the insertion part 111 is reduced by the shape of the side wall 122, and then, the insertion part 111 is firmly coupled with the post terminal of the storage battery in close contact with the post terminal. At this time, since the side wall 122 of the head portion 121 is tapered in such a way that the diameter of the head portion 121 is gradually reduced toward the upper portion of the head portion 121, when the head portion 121 is mounted deeper, the coupling between the insertion part 111 and the post terminal becomes more firm.

Furthermore, the connection terminal according to the first preferred embodiment of the present invention has further advantages in that anybody can easily operate it since the insertion part 111 and the post terminal of the storage battery are firmly coupled with each other only by a user's power without using any separate tool, and in that it can prevent damage of the post terminal of the storage battery due to excessive external force.

In a second preferred embodiment of the present invention, as shown in FIGS. 5 to 10, a connection terminal for a storage battery includes: a fixing plate 212 having a hole of a predetermined size formed at the center thereof; a fixing member 213 vertically mounted in the hole of the fixing plate 212; an insertion part 211 mounted at a side of the fixing plate 212 and formed in a round shape opened at a side thereof for inserting a post terminal of the storage battery thereto; a pair of projection plates 214 extending from the opened portion of the insertion part 211 in a direction opposed to the fixing plate 212; a cover 220 for covering the insertion part 211 to prevent damages due to sulfurous acid gas generated from the storage battery and reduce a diameter of the insertion part 211; a hinge pin 215 for rotatably coupling a hinged portion 214' of the projection plate 214 and a hinged portion 220' of the cover 220 with each other; a terminal 217 mounted between the fixing plate 212 and the cover 220, the terminal having a hole for inserting the fixing member 213 thereinto and a connection wire for supplying electricity from the storage battery; and a fixing nut 216 coupled to the fixing member 213 for fixing the terminal 217 on the fixing plate 212 in a state where a washer is interposed between the terminal 217 and the fixing nut 116.

The cover 220 includes a head portion 221 having the hinged portion 220' formed on the side thereof and side walls 222 spaced apart from each other at a predetermined interval and surrounding the insertion part 211, a grip 223 extending from the upper surface of the head portion 221, and interval-keeping member 225 respectively mounted at the front side and the rear side of the head portion 221 for preventing expansion of an interval between the side walls 222 when the cover 220 is coupled with the insertion part 211. Moreover, the sidewalls 222 are tapered in such a way that the inner diameter is gradually reduced from the opened bottom to the top, and the diameter of the insertion part 211 is gradually reduced when the cover 220 is coupled with the insertion part 211 deeply.

Figure 5:
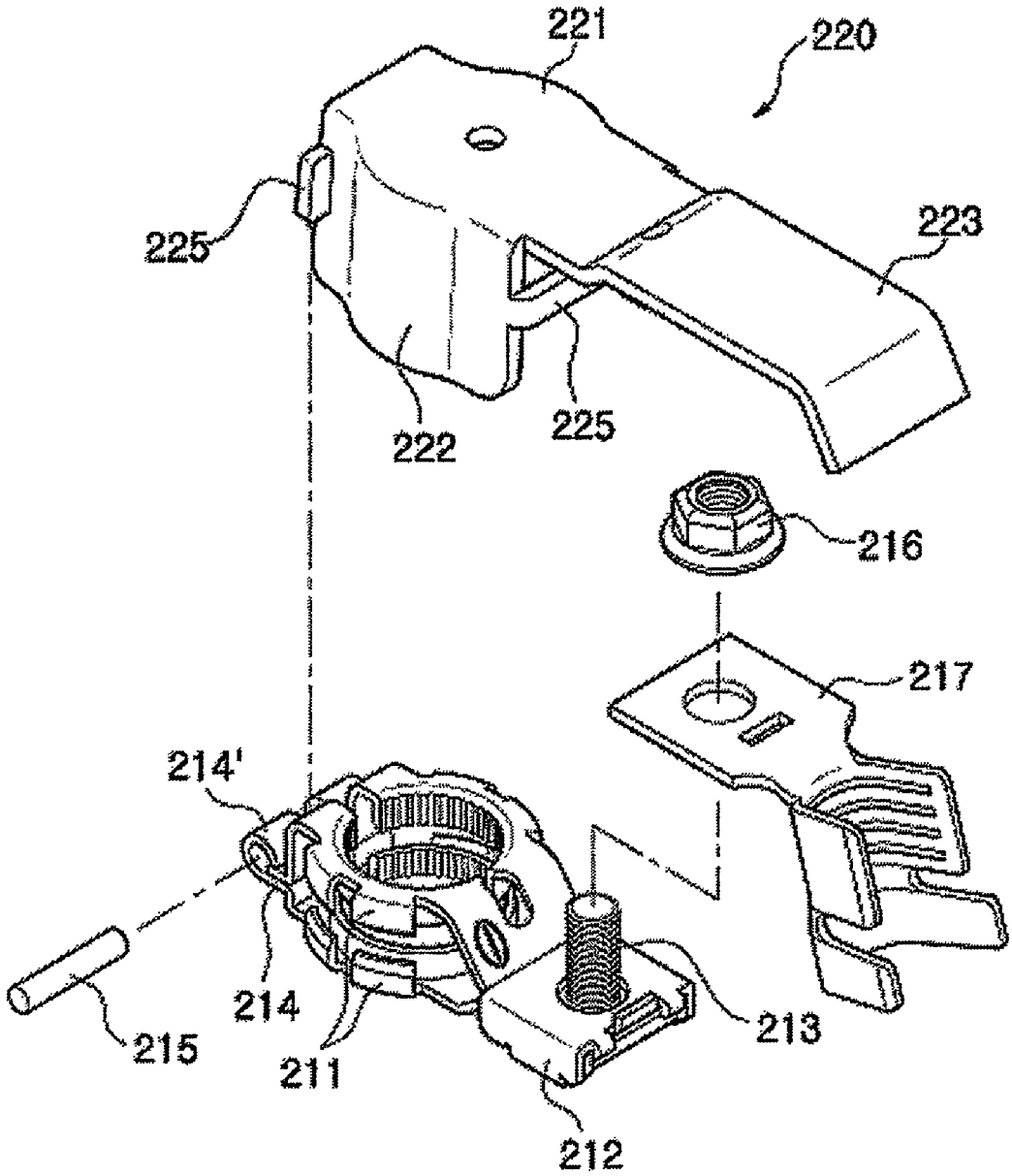
FIG. 5 is an exploded perspective view of a connection terminal for a storage battery according to a second preferred embodiment of the present invention.
Figure 6:
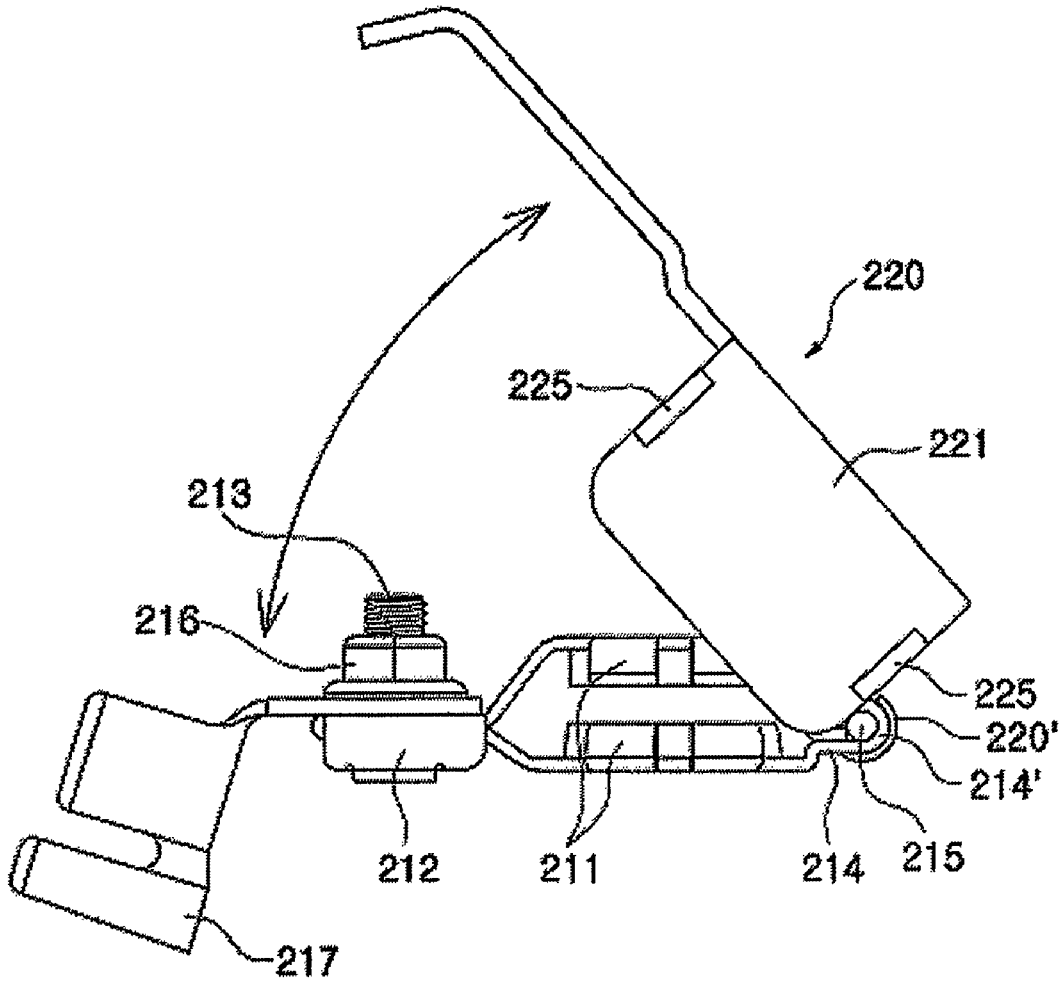
FIG. 6 is a view showing a used state of the second preferred embodiment of the present invention.
Figure 7:
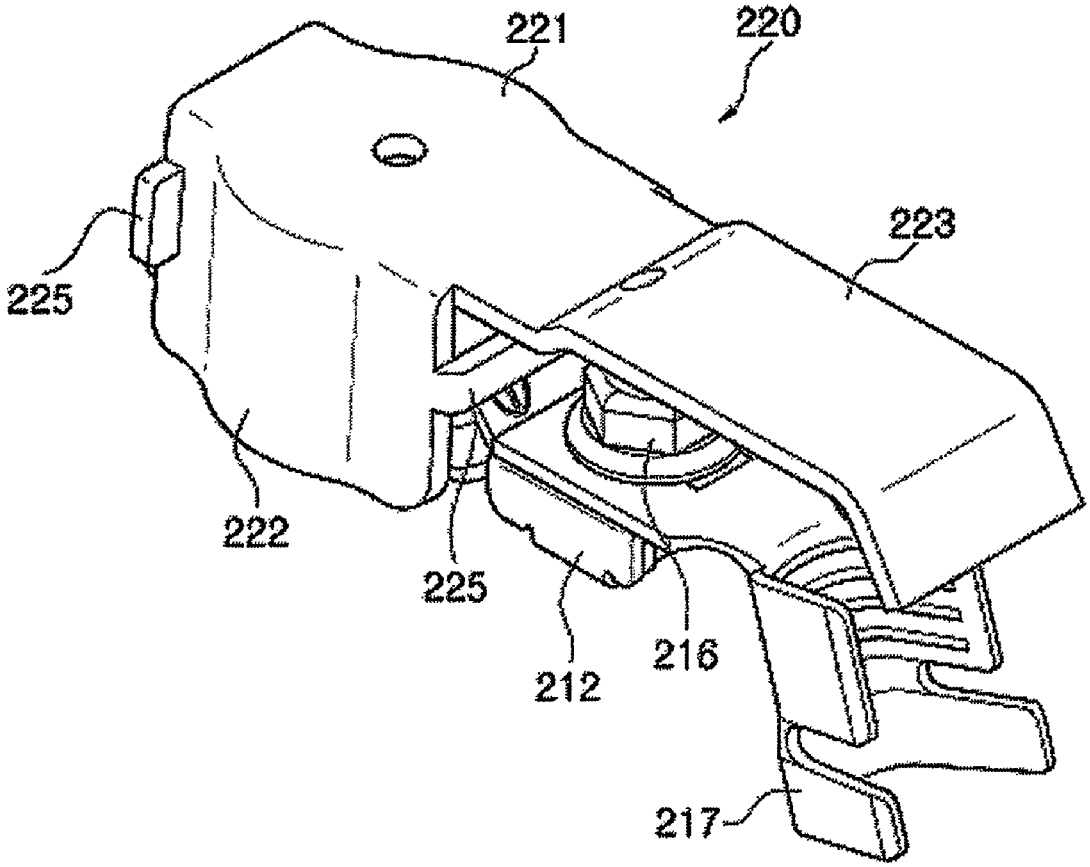
FIG. 7 is a perspective view showing a state after a diameter change of an insertion part according to the second preferred embodiment of the present invention.
Figure 8:
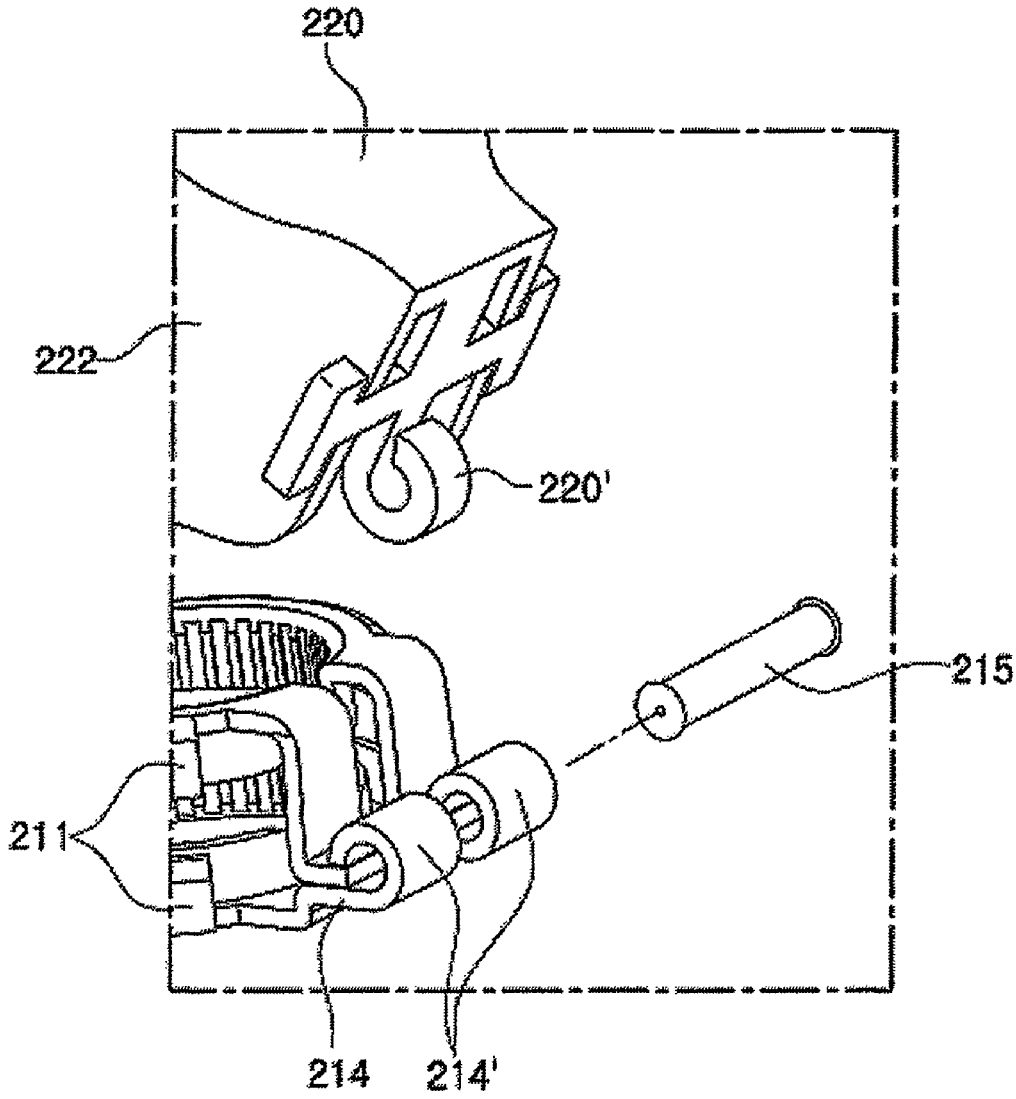
FIG. 8 is a detailed view of a hinge part of the connection terminal for the storage battery according to the second preferred embodiment.
Figure 9:
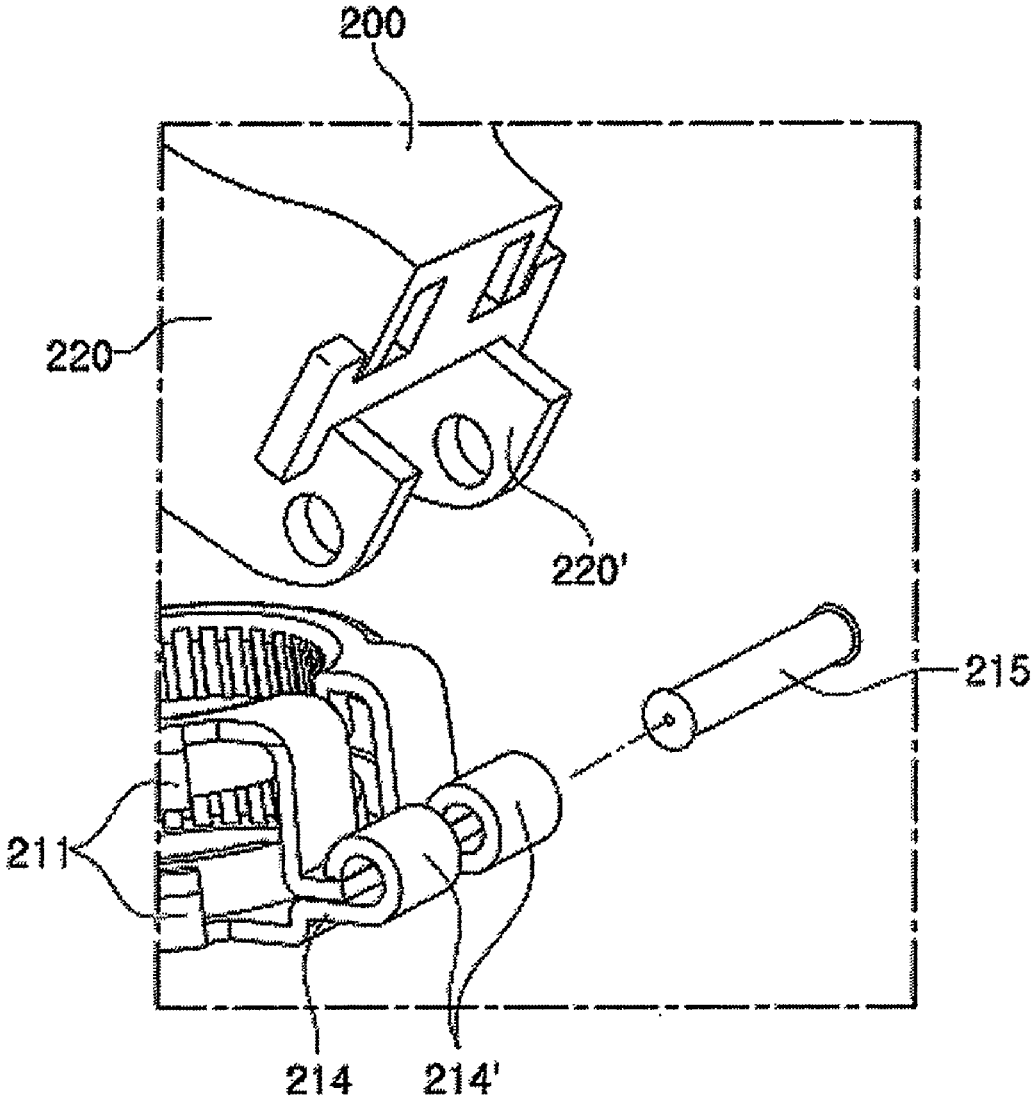
FIG. 9 is a view showing another example of the hinge part.
Figure 10:
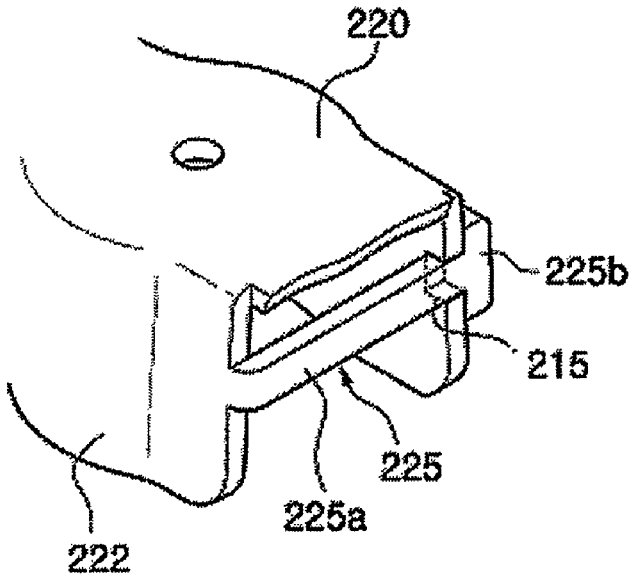
FIG. 10 is a detailed view showing a mounted example of interval-keeping means according to the second preferred embodiment of the present invention.
Figure 10:
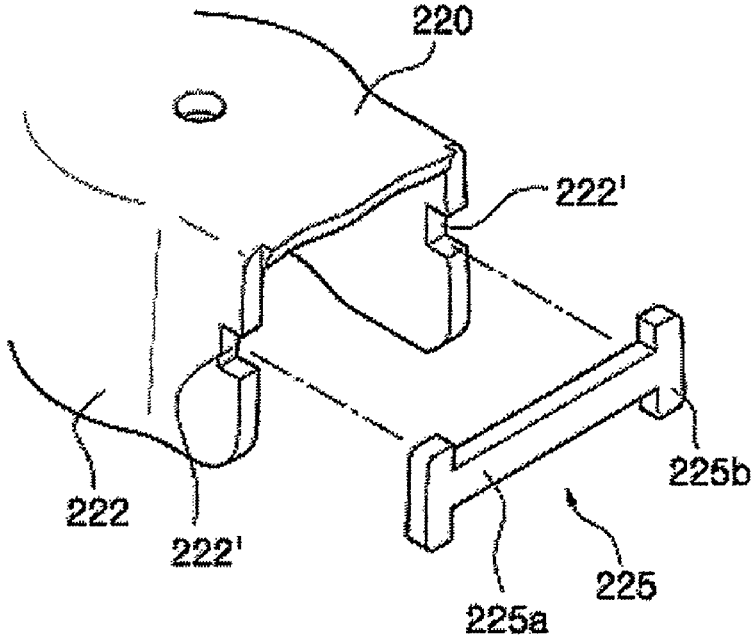

Here, as shown in FIG. 5, the hinged portion 220' of the cover 220 can be formed at a portion which is extended from the central portion of the rear end of the cover 220 as shown in FIG. 5, or be formed in such a way that the rear end of the side wall 222 of the cover 220 is extended. In the case of the former, the hinged portion 220' of the cover 220 is located between the projection plate 214 and the hinged portion 214' for the firm coupling. In the case of the latter, the hinged portion 220' of the cover 220 is located on the outer circumference of the hinged portion 214' of the projection plate 214, whereby the cover 220 and the insertion part 211 are coupled easily, the user can open and close the cover 220 easily, and it is prevented that the hinged portion 214' of the projection plate 214 is transformed.

The interval-keeping member 225 includes a straight portion 225*a* of a predetermined width which is inserted into slots 222' respectively formed in the side walls 222, and holding portions 225*b* formed at both ends of the straight portion 225*a* and being greater in size than the slots 222' of the side walls 222 for preventing enlargement of an interval between the side walls 222. At this time, it is also possible that a side end portion of the straight portion 225*a* is formed integrally with one side wall and the holding portion 225*b* is formed only at the other side end portion and held to the slot 222' of the other side wall. In the second preferred embodiment of the present invention, the interval-keeping member 225 located at the front portion of the sidewall 222 has the above form.

The connection terminal can be firmly coupled to the post terminal of the storage battery only by mounting the cover.

To install the terminal 217, the insertion part 211 is located at a position where the post terminal of the storage battery is fit to the connection terminal, the terminal 217 is located at a position where the connection wire connected to the corresponding post terminal is mounted on the terminal 217, and the fixing nut 216 is coupled with the fixing member 213 in a state where the washer is interposed between the terminal 217 and the fixing nut 216. At this time, instead of interposing the washer, as shown in the drawing, a washer-faced nut can be used as the fixing nut 216.

After that, the cover 220 is coupled with the projection plate 214 extending from the insertion part 211. That is, the hinged portion 214' formed on the upper portion of the projection plate 214 and the hinged portion 220' of the cover 220 are located in a straight line, and the hinge pin 215 is inserted into the hinged portions, so that the projection plates 214 and the cover 220 are hingedly coupled with each other.

After that, the head portion 221 of the cover 220 is fit on the outer circumference of the insertion part 211 by rotation of the cover 220 hingedly coupled with the projection plates 214. Therefore, the diameter of the insertion part 211 is reduced by the tapered sidewalls 222 of the head portion 221 of the cover 220, so that the insertion part 211 is firmly coupled to the post terminal of the storage battery. At this time, due to the interval-keeping member 225 disposed at the front and rear sides of the side wall 222, it is prevented that the interval between the side walls 222 is enlarged more than a predetermined distance.

Consequently, the insertion part 211 of the connection terminal can be firmly coupled with the post terminal of the storage battery by mounting just the cover 220 without using any separate tightening member. Moreover, separation of the cover 220 from the projection plates 214 can be prevented, and it can be prevented that the sidewalls 222 of the cover 220 are spaced further from each other when the insertion part 211 is tightened.

Also in the second preferred embodiment of the present invention, since the insertion part 211 of the connection terminal can be firmly coupled with the post terminal of the storage battery by mounting just the cover 220, the connection terminal for the storage battery has advantages in that it is easy to install the connection terminal, and in that the connection terminal provides a simple appearance and an easy layout and prevents that the cover 220 is separated from the insertion part 211 since the cover 220 and the terminal 217 are mounted in the same direction by the hinged coupling between the projection plate 214 and the cover.

Furthermore, according to the second preferred embodiment of the present invention, sufficient tightening force is applied to the insertion part 211 since the interval of the sidewalls 222 of the cover 220 is not enlarged by the interval-keeping member 225 when the cover 220 is coupled with the insertion part 211.

Moreover, also in the second preferred embodiment of the present invention, the connection terminal for the storage battery permits anybody to easily operate it and can prevent damage of the post terminal of the storage battery due to excessive external force, since the insertion part 111 and the post terminal of the storage battery are firmly coupled with each other only by a user's power without using any additional tool.

As described above, according to the connection terminal for the storage battery of the present invention, the insertion part of the connection terminal can be firmly coupled with the post terminal of the storage battery by mounting just the cover without using any separate tightening member. Moreover, the connection terminal permits anybody to easily operate it and can prevent damage of the post terminal of the storage battery due to excessive external force, since the insertion part 111 and the post terminal of the storage battery are firmly coupled with each other only by a user's power without using any additional tool.

In addition, the connection terminal for the storage battery according to the present invention provides a simple appearance and an easy layout and prevents that the cover is separated from the insertion part since the cover and the terminal are mounted in the same direction by the hinged coupling between the projection plate and the cover.

Additionally, according to connection terminal for the storage battery of the present invention, sufficient tightening force is applied to the insertion part since the interval of the sidewalls of the cover is not enlarged by the interval-keeping member when the cover is coupled with the insertion part.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A connection terminal for a storage battery, which includes a fixing plate having a hole of a predetermined size formed at the center thereof, a fixing member vertically mounted in the hole of the fixing plate, an insertion part mounted at a side of the fixing plate and formed in a round shape opened at a side thereof for inserting a post terminal of the storage battery thereto, and a tightening member for coupling the insertion part with a post terminal of the storage battery by changing a diameter of the insertion part, wherein the tightening member comprises:

a pair of projections extending from the opened portion of the insertion part in a direction opposed to the fixing plate;

a cover for covering the insertion part to prevent damages due to sulfurous acid gas generated from the storage battery and reduce a diameter of the insertion part; and a coupler for coupling the cover with the pair of projections to form a rotational point for the cover, the coupler including a hinged portion of the pair of projections, a hinged portion of the cover and a hinge pin, the hinge pin rotatably coupling the hinged portion of the pair of projections and the hinged portion of the cover with each other, and wherein the cover includes:

a head portion having the hinged portion on a side thereof and side walls spaced apart from each other at a predetermined interval for surrounding the insertion part;

a grip extending from an upper surface of the head portion; and interval-keeping means respectively mounted at a front aspect and a rear aspect of the head portion for preventing expansion of an interval between the side walls when the cover is coupled with the insertion part.

2. The connection terminal for a storage battery according to claim 1, the cover including side walls for surrounding the insertion part, wherein the hinged portion of the cover is extended from the rear end of the side walls, and the hinged portion of the pair of projections is located on the outer surface of the insertion part.

3. The connection terminal for a storage battery according to claim 1, further comprising a terminal having a hole for inserting the fixing member thereinto and fixed on the fixing plate by a fixing nut coupled to the fixing member.

4. The connection terminal for a storage battery according to claim 1, wherein the side walls define an inner diameter therebetween and include an open bottom and a top, wherein the side walls are tapered in such a way that the inner diameter is gradually reduced from the opened bottom to the top thereof.

5. The connection terminal for a storage battery according to claim 1, wherein the hinged portion of the cover is extended from the rear end of the side wall, and the hinged portion of the pair of projections is located on the outer surface of the insertion part.

6. The connection terminal for a storage battery according to claim 1, further comprising a terminal having a hole for inserting the fixing member thereinto and fixed on the fixing plate by a fixing nut coupled to the fixing member.

7. The connection terminal for a storage battery according to claim 1, wherein the interval-keeping means include:

a straight portion of a predetermined width inserted into slots respectively formed in the side walls; and holding portions formed at a first end and a second end of the straight portion and being greater in size than the slots of the side walls for preventing enlargement of an interval between the side walls.

8. The connection terminal for a storage battery according to claim 7, wherein the first end of the straight portion of the interval-keeping means is formed integrally with one side wall of the head portion, and the holding portion is formed only at the second end of the straight portion and held to the slot of the side wall.

* * * * *